US006705464B1

(12) United States Patent
Yang

(10) Patent No.: US 6,705,464 B1
(45) Date of Patent: Mar. 16, 2004

(54) BELT FOR COLLATED NAILS FOR AIR-DRIVEN NAILING GUN

(75) Inventor: Brad Yang, Taichung Hsien (TW)

(73) Assignee: Testo Industry Corp. (TW)

( * ) Notice: Subject to any disclaimer, the term of this patent is extended or adjusted under 35 U.S.C. 154(b) by 0 days.

(21) Appl. No.: 10/237,037

(22) Filed: Sep. 9, 2002

(51) Int. Cl.[7] ..... B65D 85/24
(52) U.S. Cl. ..... 206/345; 206/347; 411/443
(58) Field of Search ..... 206/338–347, 206/443, 820; 411/442–444

(56) References Cited

U.S. PATENT DOCUMENTS 4,881,643 A * 11/1989 Pfister ..... 206/343
5,069,340 A * 12/1991 Ernst et al. ..... 206/347
5,865,311 A * 2/1999 Hentges et al. ..... 206/347
5,931,622 A * 8/1999 Gupta et al. ..... 411/443
6,044,972 A * 4/2000 Rohrmoser et al. ..... 206/347

* cited by examiner

*Primary Examiner*—Luan K. Bui
(74) *Attorney, Agent, or Firm*—Donald C. Casey

(57) ABSTRACT

A belt of collated nails for use with an air-driven nailing gun is disclosed having a plurality of nails, a plurality of flexible nail guide caps connected in series and respectively capped on the points of the nails and adapted to guide the nails into the workpiece, and a plurality of breakable flexible sockets connected in series and spaced above the flexible nail guide caps and adapted to hold the nails in the flexible nail guide caps, the breakable flexible sockets each having a through hole for receiving the nails respectively.

2 Claims, 3 Drawing Sheets

PRIOR ART

BELT FOR COLLATED NAILS FOR AIR-DRIVEN NAILING GUN

BACKGROUND OF THE INVENTION

1. Field of the Invention

The present invention relates to air-driven nailing guns and, ore specifically, to a belt of collated nails for air-driven nailing gun.

2. Description of the Related Art

FIG. 1 illustrates a regular commercially available air-driven nailing gun 5 adapted for driving nails into the workpiece. The air-driven nailing gun 5 comprises a nail conveyer 51 adapted for conveying a plastic belt 7 collated nails 6 along a sliding track 511 to the head of the air-driven nailing gun 5 for driving into the workpiece by a driving mechanism (not shown). This conveying arrangement between the air-driven nailing gun 5 and the belt collated nails 6 has drawbacks as outlined hereinafter: 1. Low accuracy and stability: When one nail 6 moved out of the sliding track 511 to the nailing position in the head of the air-driven nailing gun 5, it is not well supported in perfect alignment with the expected target at the workpiece, and the air-driven nailing gun 5 has no means to guide the nail 6 into the workpiece, for example, concrete wall along a fixed path. When the nails 6 of one belt have been completely driven into the workpiece, the heads of the nails 6 are not all maintained in flush with the surface of the workpiece. 2. High manufacturing cost: In order to reduce the weight, the body of the air-driven nailing gun 5 is made of aluminum alloy. However, the sliding track 511 wears quickly with use when maintained in direct contact with the nails 6. Therefore, a steel packing plate 512 is used and covered over the sliding track 511 to prevent quick wearing of the sliding track 511. However, the installation of the steel packing plate 512 greatly increases the manufacturing cost of the air-driven nailing gun 5. 3. Unstable nail output: Because plastic or paper belt collated nails 6 are used, plastic or paper scraps may be jammed in the nailing gun to block the nail output nozzle.

SUMMARY OF THE INVENTION

The present invention eliminates the aforesaid problem. It is the main object of the present invention to provide a belt of collated nails for air-driven nailing gun, which enables the nails to be driven into the workpiece accurately and stably. It is another object of the present invention to provide a belt of collated nails for air-driven nailing gun, which does not cause the internal mechanism of the air-driven nailing gun to wear quickly with use. According to the present invention, the belt of collated nails comprises a plurality of nails, a plurality of flexible nail guide caps connected in series and respectively capped on the points of the nails and adapted to guide the nails into the workpiece, and a plurality of breakable flexible sockets connected in series and spaced above the flexible nail guide caps and adapted to hold the nails in the flexible nail guide caps, the breakable flexible sockets each having a through hole for receiving the nails respectively.

DETAILED DESCRIPTION OF THE PREFERRED EMBODIMENT

Figure 1:
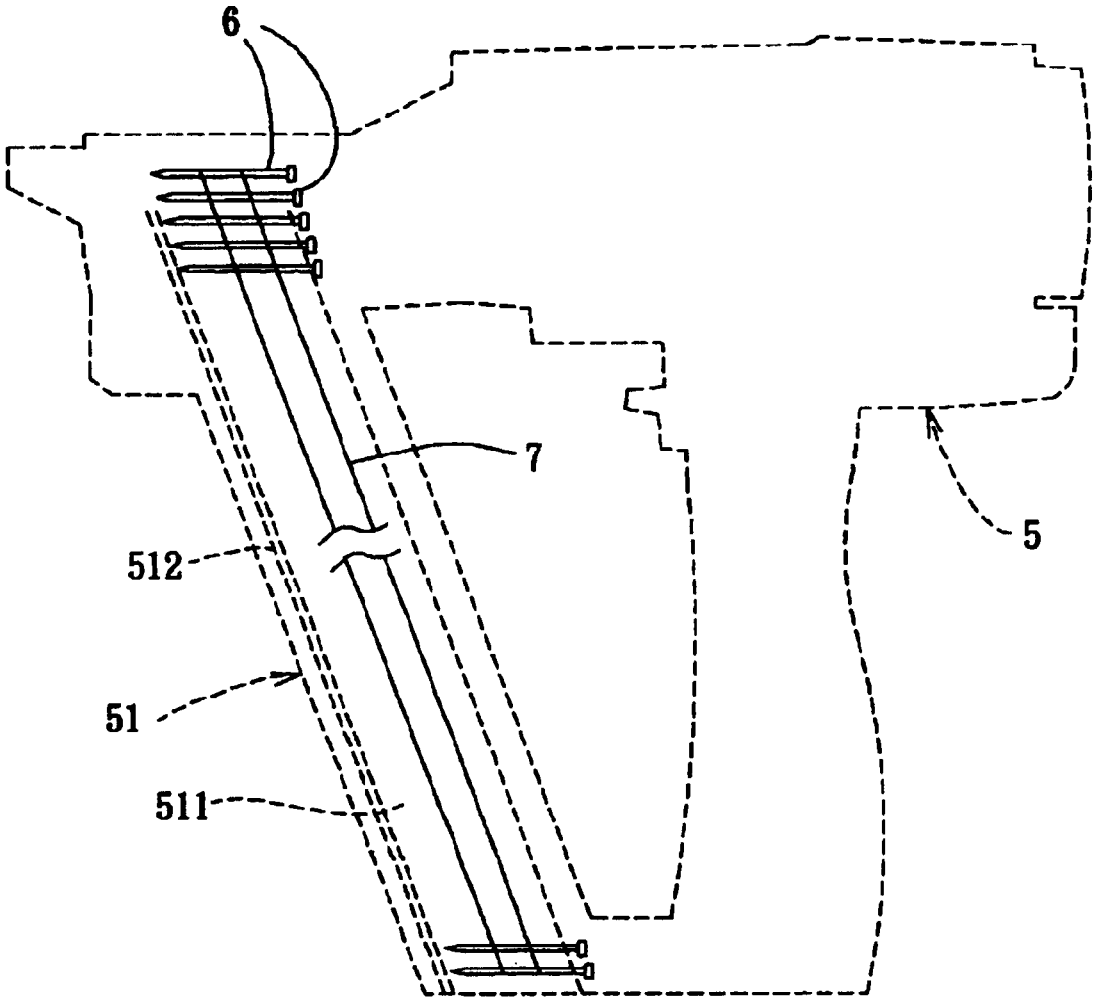
FIG. 1 illustrates the arrangement of a belt of collapsed nails in the sliding track of an air-driven nailing gun according to the prior art.
Figure 2:
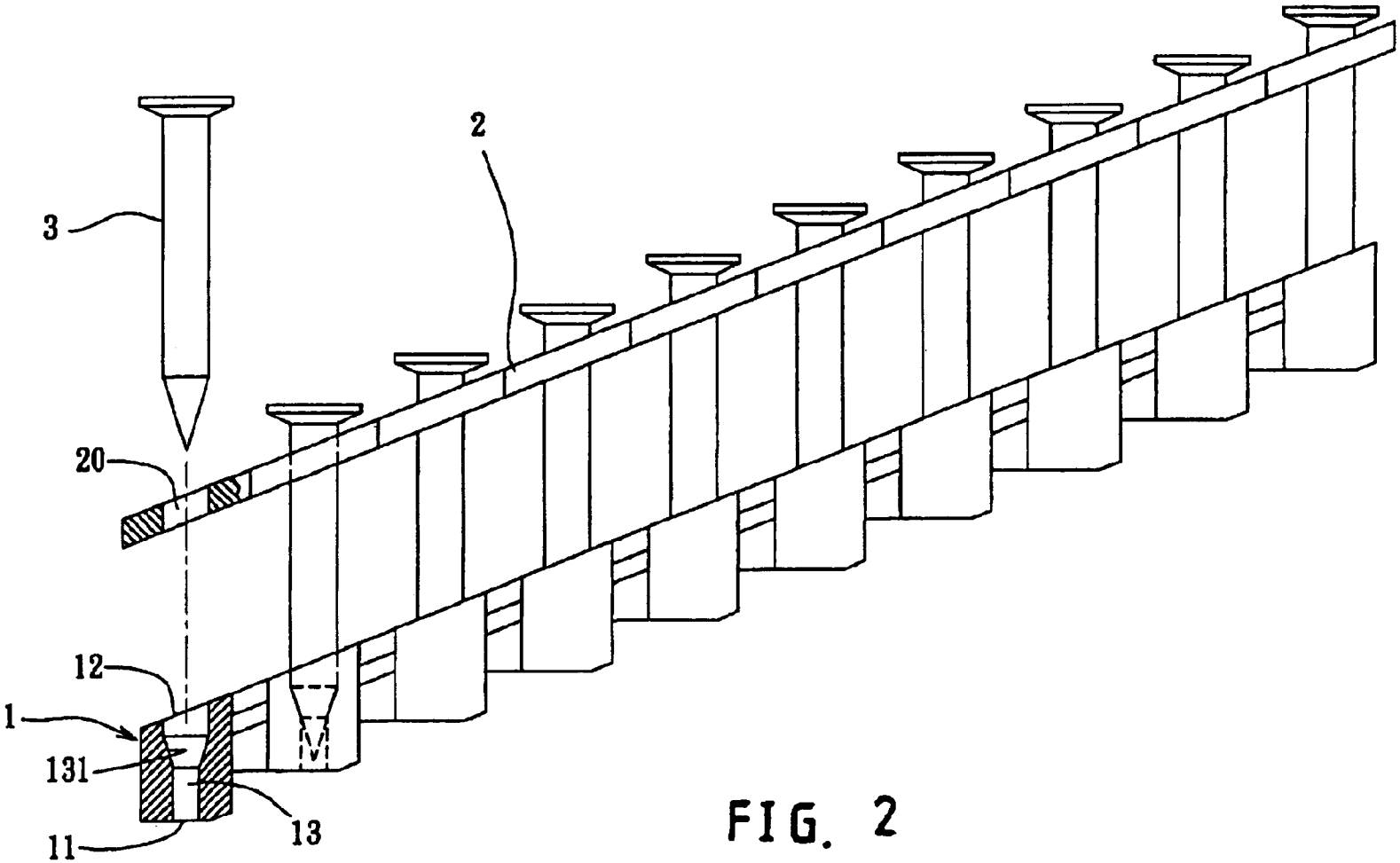
FIG. 2 is an exploded view of a belt of collated nails according to the present invention.

Referring to FIG. 2, a belt of collated nails in accordance with the present invention comprises a plurality of nails 3, a series of breakable flexible plastic sockets 2, and a plurality of flexible nail guide caps 1 collated into a bar. The series of flexible plastic sockets 2 are injection-molded from plastics in integrity. Each plastic socket 2 has a through hole 20 extended through the top and bottom sides. The nails 3 are respectively inserted through the through holes 20 of the flexible plastic sockets 2, keeping the heads of the nails 3 respectively rested on the top side of the series of flexible plastic sockets 2. The flexible nail guide caps 1 are respectively capped on the points (conical tips) of the nails 3. The collated flexible nail guide caps 1 are injection-molded from flexible plastics. Each flexible nail guide cap 1 has a flat bottom side 11, a beveled top side 12, and a through hole 13 extended through the flat bottom side 11 and the beveled top side 12. The through hole 13 has a tapered upper section 131 fitting the conical tip of each nail 2. When installed, the beveled top sides 12 of the flexible nail guide caps 1 are aligned in a line, and the series of flexible plastic sockets 20 is disposed in parallel to the line of the beveled top sides 12 of the flexible nail guide caps 1.

Figure 3:
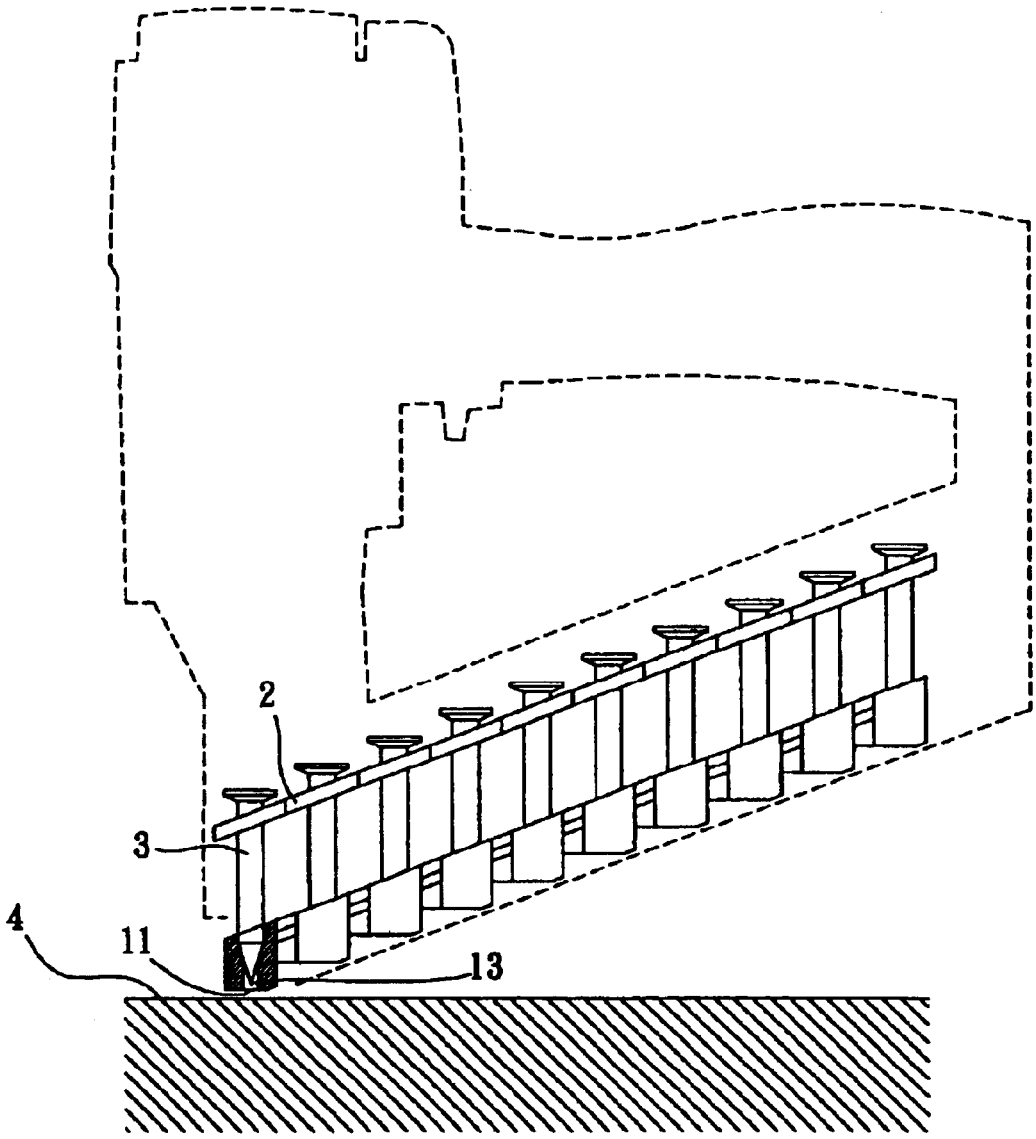
FIG. 3 shows an application example of the present invention.

Referring to FIG. 3, when the nails 3 moved by the nail conveyer of the air-driven nailing gun along the sliding track, the flexible nail guide caps 1 prevent direct contact between the points of the nails 3 and the surface of the sliding track. Therefore, the sliding track of the air-driven nailing gun does not wear quickly with the use of the air-driven nailing gun.

Referring to FIG. 3 again, when one nail 3 moved to the nailing position, the respective flexible nail guide cap 1 is stopped at the surface of the workpiece 4 to guide the nail 3 accurately and stably into the workpiece 4. When one nail 3 driven into the workpiece 4, the driven nail 3 breaks the corresponding flexible plastic socket 2 and the corresponding flexible nail guide cap 1, and the broken flexible plastic socket 2 and flexible nail guide cap 1 fly away from the nailing area without interfering with the next nailing action.

As indicated above, the flexible nail guide caps 1 protect the points of the nails 2 from contacting the sliding track of the air-driven nailing gun, therefore it is not necessary to reinforce the sliding track with a steel packing plate. By means of the guidance of the flexible nail guide caps 1, the heads of the nails 3 are maintained in flush with the surface of the workpiece, for example, a concrete wall or steel plate when driven into position.

A prototype of belt of collated nails has been constructed with the features of FIGS. 2 and 3. The belt of collated nails functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A belt of collated nails for use with an air-driven nailing gun, comprising a plurality of nails, said nails each having a conical tip terminating in a point, and a plurality of flexible nail guide caps connected in series and respectively capped on the conical tips of said nails and adapted to guide said nails into the workpiece, wherein a plurality of breakable flexible sockets are connected in series and adapted to hold said nails in said flexible nail guide caps, said breakable flexible sockets each having a through hole extended through top and bottom sides thereof for receiving said nails respectively.

2. The belt of collated nails as claimed in claim 1, wherein said breakable flexible sockets are molded from flexible plastics.

* * * * *